US005187339A

United States Patent [19]

Lissandrin

[11] Patent Number: 5,187,339

[45] Date of Patent: Feb. 16, 1993

[54] GAS INSULATED HIGH-VOLTAGE CIRCUIT BREAKER WITH PNEUMATIC OPERATING MECHANISM

[75] Inventor: Mario Lissandrin, Battaglia Terme, Italy

[73] Assignee: Merlin Gerin, France

[21] Appl. No.: 714,868

[22] Filed: Jun. 13, 1991

[30] Foreign Application Priority Data

Jun. 26, 1990 [FR] France ..... 90 08356

[51] Int. Cl.[5] ..... H01H 33/28

[52] U.S. Cl. ..... 200/148 F; 200/82 B; 200/148 B

[58] Field of Search ..... 200/82 B, 148 R, 148 B, 200/148 D, 148 F, 148 H

[56] References Cited

U.S. PATENT DOCUMENTS

| | | | |
|---|---|---|---|
| 3,379,849 | 4/1968 | Easley | 200/148 B |
| 3,569,651 | 3/1971 | Gratzmuller | 200/148 G |
| 3,743,804 | 7/1973 | Frowein | 200/148 B |
| 3,745,280 | 7/1973 | Pratsch et al. | 200/82 B |
| 3,766,343 | 10/1973 | Gratzmuller | 200/82 B |
| 4,016,383 | 4/1977 | Nicoloso | 200/148 F |
| 4,118,613 | 10/1978 | Barkan et al. | 200/82 B |
| 4,384,182 | 5/1983 | Iman | 200/82 B |
| 4,467,157 | 8/1984 | Nicoloso et al. | 200/148 F |
| 4,739,136 | 4/1988 | Coudert et al. | 200/148 D X |
| 4,788,391 | 11/1988 | Lutz | 200/148 F |

FOREIGN PATENT DOCUMENTS 2707594 8/1978 Fed. Rep. of Germany .

*Primary Examiner*—J. R. Scott

*Attorney, Agent, or Firm*—Parkhurst, Wendel & Rossi

[57] ABSTRACT

A high-voltage circuit breaker includes a first compartment with SF6 under pressure having stationary and movable contacts therein, and a second sealed compartment housing having an operating mechanism with a pneumatic jack actuated by the gas contained in the first compartment via closing and opening valves. The second sealed enclosure is at low pressure playing the role of expansion volume of the gas expelled from the jack at the end of travel of the piston. The gas pressure in the jack is controlled by means of a control device sensitive to the temperature variation of the gas under pressure in the first compartment.

11 Claims, 7 Drawing Sheets

GAS INSULATED HIGH-VOLTAGE CIRCUIT BREAKER WITH PNEUMATIC OPERATING MECHANISM

BACKGROUND OF THE INVENTION

The invention relates to a high-voltage gas-insulated circuit breaker or switch comprising a first sealed compartment filled with insulating gas under pressure and with a high dielectric strength, notably sulphur hexafluoride SF6, and containing at least one breaking pole having a pair of separable contacts, an arc extinguishing device rendered active when separation of the contacts takes place, and an actuating rod coupled to an opening and closing operating mechanism.

High-voltage circuit breakers with gas-blast by compression of SF6 gas generally use a hydraulic operating mechanism fixed to the base of the circuit breaker support insulator, comprising a hydraulic jack coupled to the insulating actuating rod of the moving assembly. In addition to the jack, a hydraulic mechanism comprises tanks for storing oil under pressure, and numerous safety and control devices connected to the jack and tanks by a plurality of high-pressure pipes. The tightness of the hydraulic circuit of the mechanism has to be monitored, as well as that of the insulating gas of the pole. The manufacturing and maintenance cost of such a circuit breaker is high.

The object of the invention consists in simplifying the operation of a high-voltage circuit breaker.

SUMMARY OF THE INVENTION

The circuit breaker according to the invention is characterized in that the operating mechanism is housed in a sealed enclosure bounding a second compartment juxtaposed to the first compartment, and comprises a pneumatic jack whose moving piston is actuated by the SF6 gas under pressure contained in the first compartment on each closing or opening operation, the second, low pressure, compartment playing the role of expansion volume of the gas expelled from the jack at the end of the closing or opening travel of the piston.

The pneumatic jack operates in conjunction with distribution means located in the second compartment to allow gas under pressure contained in the first compartment to be inlet into the jack when the outlet between the jack and the second low pressure compartment is closed, and vice-versa to allow the jack to communicate with the second compartment when the inlet of gas under pressure is interrupted.

A closing and/or opening operation of the circuit breaker by means of the pneumatic jack mechanism requires a fraction of the energy of the gas under pressure contained in the first compartment. The same SF6 gas is used for insulation, arc breaking, and operating control, which simplifies manufacturing and reduces the cost of the circuit breaker.

The pressure increase of the SF6 in the first compartment due to the presence of the arc when the contacts separate also contributes to supplying gas to the jack for the subsequent opening phase of the circuit breaker.

The distribution means comprises a first valve controlled by an opening electromagnet, and a second valve controlled by a closing electromagnet, each valve having an inlet orifice between the first compartment and the jack, and an outlet orifice between the jack and the second compartment. The gas under pressure is conveyed from the first compartment to the inlet orifices of the first and second valves via two apertures, located at the level of the separating wall between the first and second compartments.

According to an embodiment of the invention, the inlet cross-section of the two apertures is controlled by a control device sensitive to the temperature variation of the gas under pressure contained in the first compartment. The useful pressure in the jack when the corresponding inlet orifice opens can thus be adjusted to a preset threshold. This results in the actuating force of the pneumatic jack being easily adaptable to suit any environment.

The sealed enclosure houses a pressure switch and a compressor having an intake orifice in connection with the second low pressure compartment, and a discharge orifice connected by a pipe to the first compartment, said pressure switch being designed to measure the differential pressure of the gas between the first and second compartments, so as to repressurize the first compartment at its setpoint value on each closing and opening operation of the operating mechanism.

All the SF6 circuit breaker operating and monitoring devices are located inside the second low pressure compartment forming a tight autonomous structure with the first high pressure compartment.

BRIEF DESCRIPTION OF THE DRAWINGS

Other advantages and features will become more clearly apparent from the following description of an illustrative embodiment of the invention, given as a non-restrictive example only and represented in the accompanying drawings, in which.

DESCRIPTION OF THE PREFERRED EMBODIMENT

Figure 1:
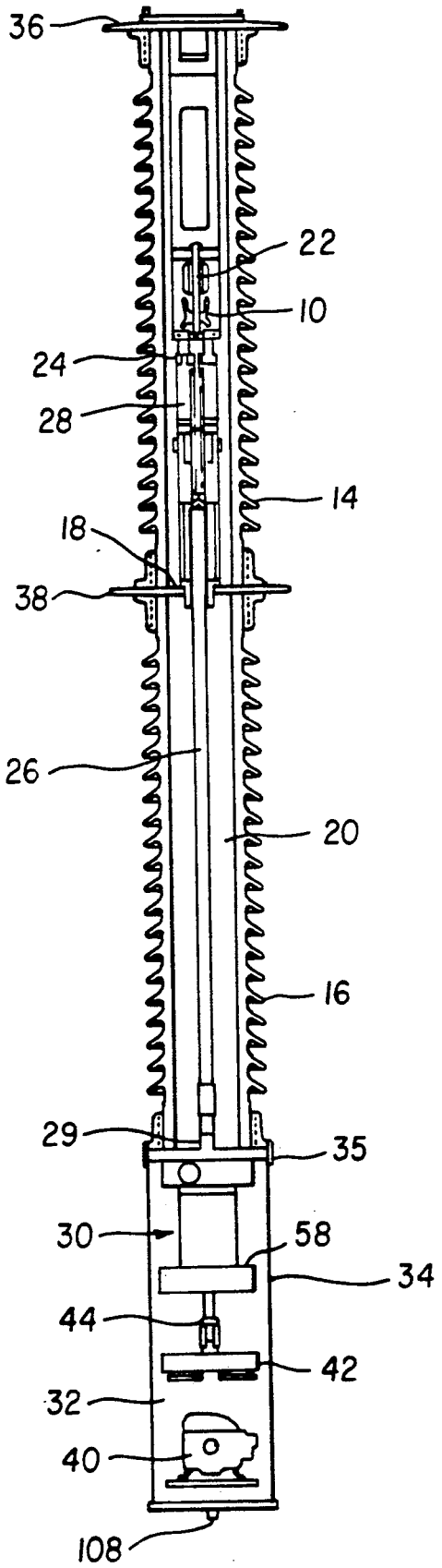
FIG. 1 is a schematic view of a gas-blast circuit breaker equipped with the operating mechanism according to the invention.
Figure 2:
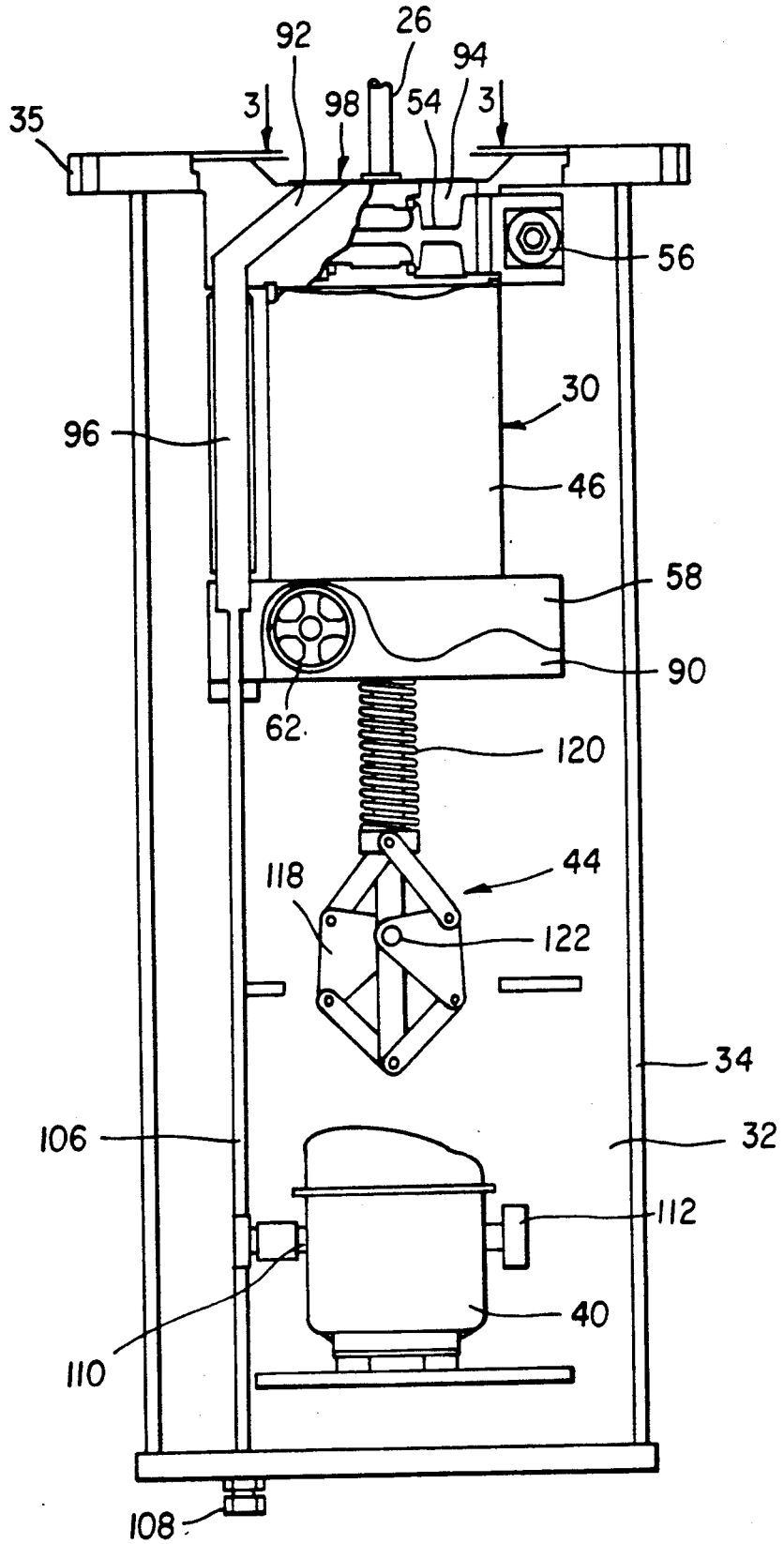
FIG. 2 shows an enlarged scale view of the mechanism in figure 1.
Figure 3:
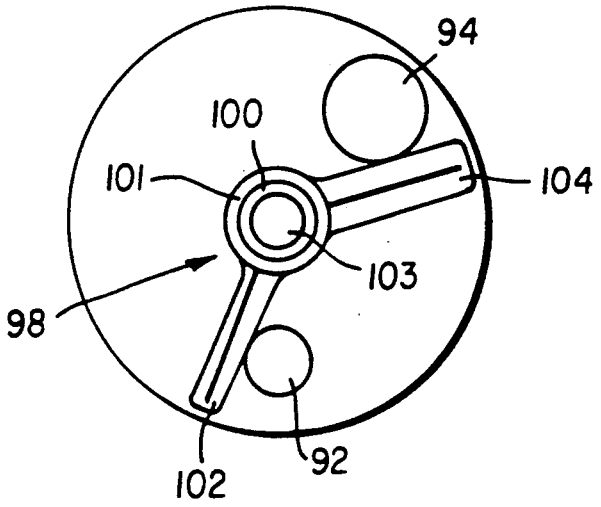
FIG. 3 is a partial view along the line 3—3 of FIG. 2.
Figure 4:
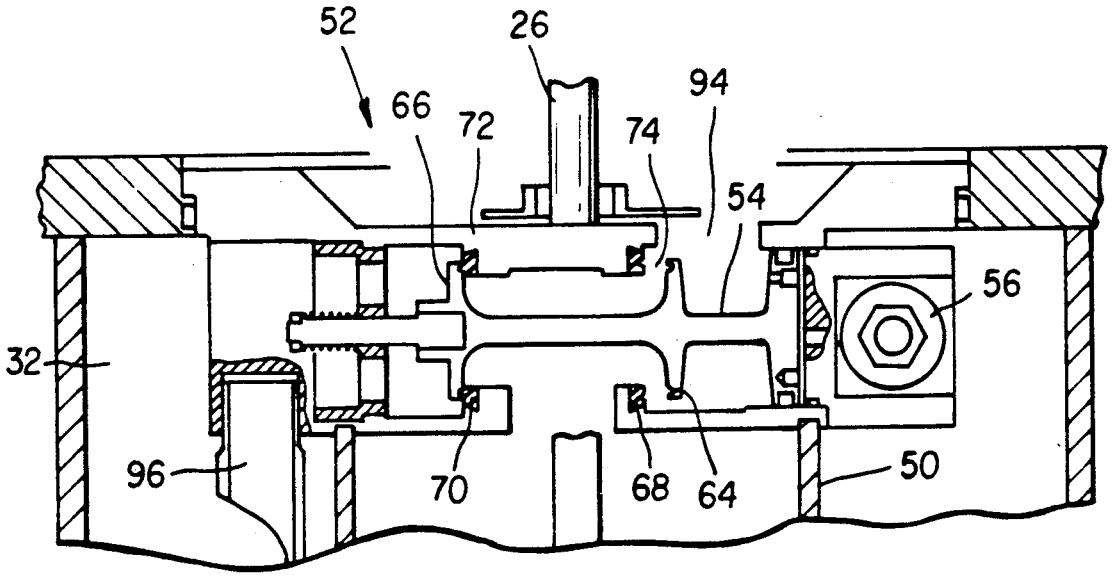
FIG. 4 represents an enlarged scale sectional view of the first distribution system of the pneumatic mechanism in FIG. 2.

Referring now to FIG. 1, a pole 10 of a high-voltage gas-insulated switch or circuit breaker 12 is housed in a first pillar-type insulator 14, supported by a second support insulator 16. The two insulators 14, 16 are cylindrical and their internal volumes communicate via apertures 18, so as to form a first sealed compartment 20 filled with insulating gas, having a high dielectric strength, notably sulphur hexafluoride SF6 under pressure. The pole 10 comprises a stationary contact 22, a movable contact 24 driven in translation by an actuating rod 26 made of insulating material, and an arc extinguishing device 28 rendered active when the contacts 22, 24 separate.

The arc extinguishing device 28 comprises for example a gas-blast chamber by compression of the SF6 by means of a piston and cylinder assembly which is moved when the actuating rod 26 moves between the open and closed positions of the circuit breaker 12.

Any other kind of arc extinguishing chamber can be used in the pole 10, notably a depression, expansion, or magnetic arc rotation chamber.

The bottom end 29 of the actuating rod 26 is coupled to o pneumatic operating mechanism 30 housed in a second compartment 32. The latter is confined in a cylindrical enclosure 34, tightly fixed to a plate 35 bearing against the base of the second insulator 16 by an assembly device. The pneumatic operating mechanism 30 is actuated by the SF6 gas under pressure contained in the first compartment 20. The second sealed compartment 32 plays the role of a closed expansion volume of the operating gas with a pressure close to or less than atmospheric pressure, whereas it is in the order of 6 bars in the first compartment 20. Joining the two compartments 20, 32 by means of the assembly device forms a single, autonomous structure using the same SF6 gas for insulation, arc breaking, and opening and closing operating control.

Electrical connection of the pole 10 is achieved by means of two connection terminals 36, 38 located at the level of the first insulator 14, and in electrical connection respectively with the stationary contact 22 and the movable contact 24.

In addition to the pneumatic operating mechanism, the enclosure 34 contains an electrical compressor 40, and an auxiliary contact device 42 associated with a tumbler type mechanical connection 44 with dead point passover.

Figure 5:
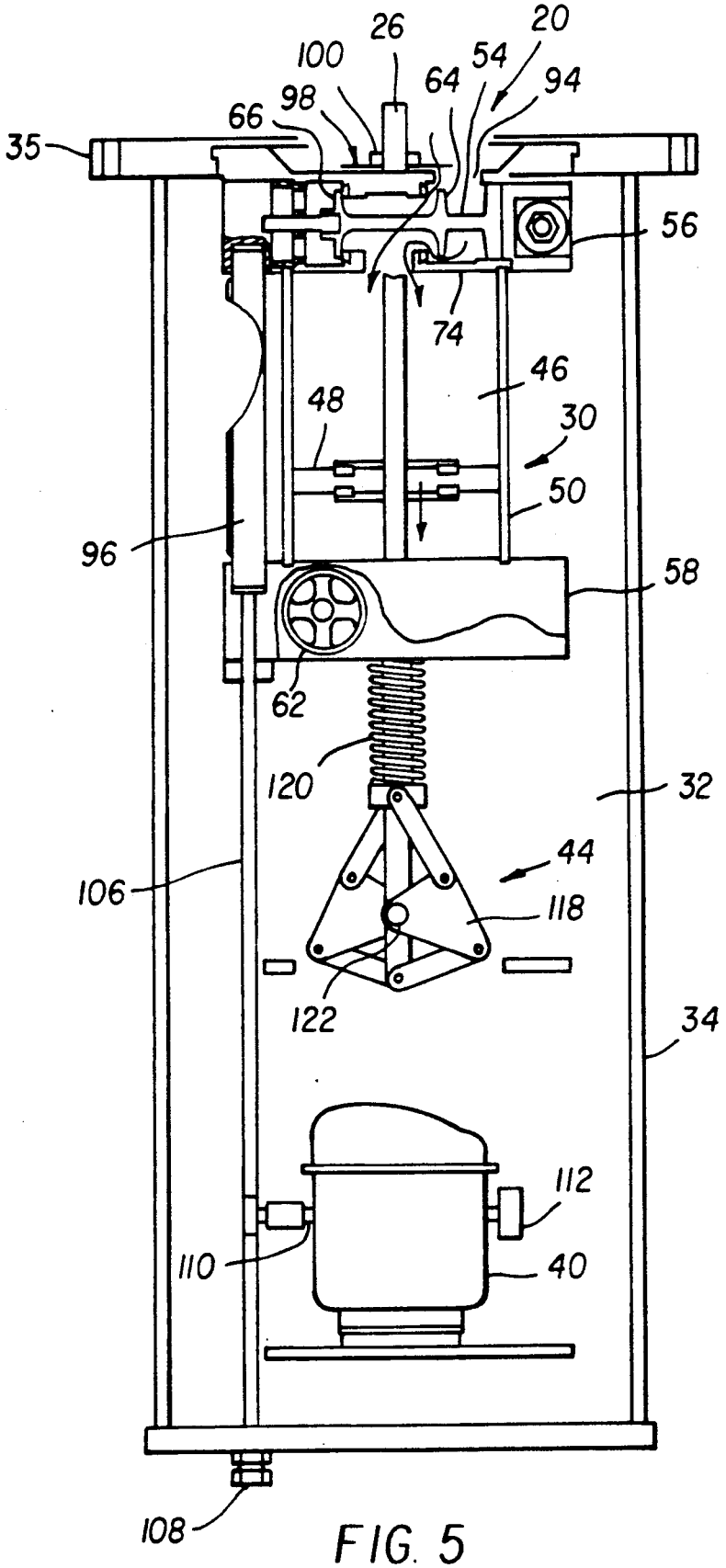
FIGS. 5 and 6 show views of the mechanism in FIG. 2, respectively during and at the end of the circuit breaker opening travel.
Figure 6:
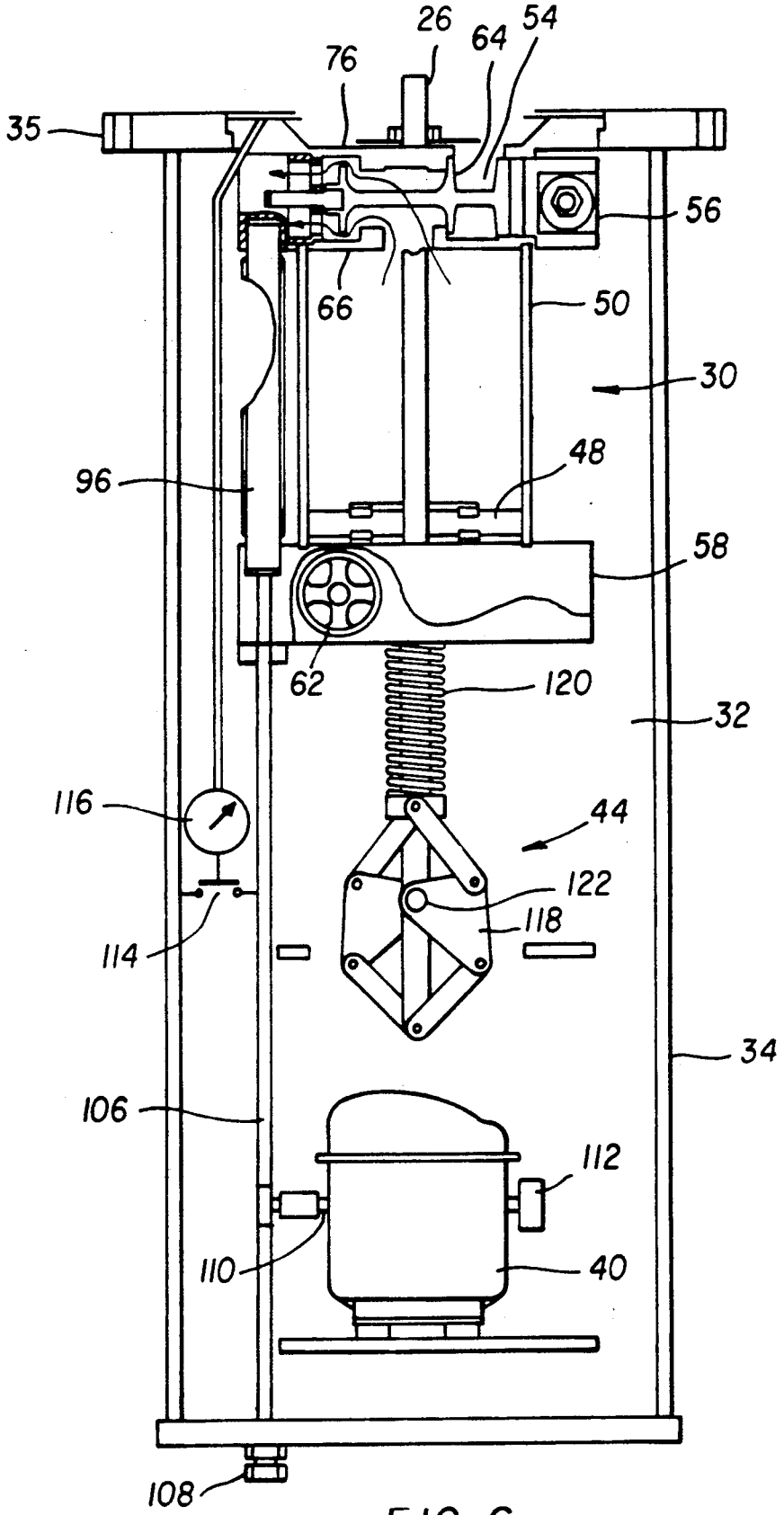

In FIGS. 2 to 8, the pneumatic operating mechanism 30 is located in the upper part of the second compartment 32, and comprises a dual-effect jack 46, whose moving piston 48 is coaxially united to the actuating rod 26 of the pole 10. The piston 48 of the jack 46 slides in a fixed cylinder 50 to ensure, either closing of the contacts 22, 24 of the circuit breaker 12 by upward translation (FIGS. 7 and 8) or opening of the contacts 22, 24 by downward translation of the piston 48 (FIGS. 5 and 6). The top plate of the cylinder 50 is adjoined to a first distribution system 52 of the operating gas, composed of a first valve 54 controled by an opening electromagnet 56. The opposite bottom plate of the cylinder 50 takes its bearing on a second distribution system 58 equipped with a second valve 60 controled by a closing electromagnet 62.

The first opening control valve 54 is shaped as a slide valve equipped with a pair of check valves 64, 66, cooperating alternately with two fixed seats 68, 70 of the body 72 depending on whether the opening electromagnet 56 is in the active or the inactive state. In the active state in FIGS. 4 and 5, the opening electromagnet 56 is energized, and the check valve 64 is separated from the corresponding seat 68 to open a first inlet orifice 74. The other check valve 66 is in engagement against the seat 70 to close a first outlet orifice 76 between the upstream volume of the jack 46 and the expansion volume of the second compartment 32. In the inactive state, the electromagnet 56 is no longer supplied (FIG. 6) bringing about opening of the outlet orifice 76 and closing of the inlet orifice 74. The body 72 is mounted tightly inside the annular plate 35.

The structure of the second valve 60 (FIGS. 7 and 8) is identical, but its arrangement is reversed with respect to that of the first valve 54. Valve 60 comprises two check valves 78, 80 capable of defining a second inlet orifice 82, and a second outlet orifice 84, respectively with two corresponding seats 86, 88 of the body 90. In the active, energized state of the closing electromagnet 62 (FIG. 7), the inlet orifice 82 is open, whereas the outlet orifice 84 is closed. In the inactive state in FIG. 8, corresponding to interruption of the power supply to the closing electromagnet 62, the inlet orifice 82 is closed, whereas the outlet orifice 84 is open.

The SF6 gas under pressure is conveyed to the inlet orifices 74, 82 of the first and second valves 54, 60 via two apertures 92, 94 (FIGS. 2 and 3), communicating with the first compartment 20, and located in a single plane at the level of the separating wall 35. The aperture 94 is arranged directly in the body 72, and is located in proximity to the first inlet orifice 74. The other aperture 92, used for closing control, communicates with the second inlet orifice 82 via a connecting pipe 96.

The two apertures 92, 94 for the gas to pass through cooperate with a control device 98 (FIGS. 2 and 3) of the gas pressure acting on the piston 48 of the jack 46, according to the temperature variations of the gas contained in the first compartment 20. The control device 98 comprises a rotary button 100 equipped with a bimetal spring 101 and two radial lugs 102, 104, having appreciably the same angular difference as the two apertures 92, 94. The button 100 is located in the first compartment 20, and the spring 101 is spiral-shaped mounted on the spindle 103 of the button 100, and its deformation reflects the temperature variation, bringing about a predetermined rotation of the button 100, and progressive or degressive overlapping of the apertures 92, 94 by the lugs 102, 104. The useful pressure of the operating gas in the jack 46 is thus adjustable to a preset threshold according to the environment in which the circuit breaker is located. The total cross-section of the aperture 92 is smaller than that of the other aperture 94, so as to adjust the actuating force of the jack 46, depending on the type of closing or opening control.

Opposite from the aperture 92, the pipe 96 is connected to a duct 106 connected to a filling orifice 108, and to the discharge orifice 110 of the compressor 40. The intake orifice 112 of the compressor 40 takes in gas at low pressure contained in the second compartment 32, as soon as the compressor 40 is started up by means of a contact 114 controled by a pressure switch 116 (FIG. 6). The latter is housed in the enclosure 34, and measures the differential pressure of the SF6 gas between the two compartments 20, 32. After a closing or openinq operation, the pressure decrease in the first compartment 20 is detected by the pressure switch 116, which closes the contact 114 supplying the compressor 40. The gas compressed by the compressor 40 is then discharged to the first compartment 20 via the duct 106, pipe 96 and aperture 92. When the pressure of the SF6 in the first compartment reaches the pressurization threshold (approximately 6 bars), the pressure switch 116 opens the contact 114 to stop the compressor 40. Repressurization of the first compartment 20 by the compressor 40 is performed automatically after each closing or opening operation of the pneumatic operating mechanism 30.

The mechanical tumbler connection 44 comprises a rod system 118 having a dead point passover coupled to the piston rod 48, and a compression spring 120 inserted between the fixed body 90 of the valve 60 of the second distribution system 58, and the top spindle of the rod system 118. The auxiliary contacts device 42 is mechanically connected to the main spindle 122 of the rod system 118, and comprises contacts indicating the open or closed position of the circuit breaker 12, and contacts supplying power to the two opening and closing electromagnets 56, 62.

Operation of the pneumatic operating mechanism 30 of the SF6 circuit breaker 12 is as follows :

OPENING

The opening sequence of the contacts 22, 24 of the circuit breaker 12 is triggered by energization of the opening electromagnet 56 (FIG. 5) of the first distribution system 52. The first valve 54 is drawn to the right, opening the first inlet orifice 74 and closing the first outlet orifice 76. The gas under pressure coming from the first compartment 20 fills the upstream volume of the jack 46 via the aperture 94 and inlet orifice 74, and causes the piston 48 to descend.

After the contacts 22, 24 have separated, the arc generates a pressure increase in the first compartment 20 which improves the gas supply to the jack 46 during the continued opening travel.

At the bottom end of travel of the piston 48 (FIG. 6), the auxiliary contacts device 42 interrupts energization of the opening electromagnet 56. The first valve 54 is urged to the left and returns automatically to its original position, closing the first inlet orifice 74 and opening the first outlet orifice 76. The gas contained in the upstream volume of the jack 46 is then expelled via the outlet orifice 76 to the expansion volume of the second compartment 32 at low pressure. Closing of the inlet orifice 74 prevents any further gas inlet at high pressure to the jack 46. The mechanical connection 44 passing over the dead point at the end of travel of the piston 48 generates an additional force which is added to the action of the pneumatic operating mechanism 30, and keeps the contacts 22, 24 in the open position after the electromagnet 56 has been de-energized. The open state of the circuit breaker 12 is indicated by the indicating contacts of the auxiliary contacts device 42.

In the course of the opening phase, energization of the closing electromagnet 62 of the second distribution system 58 is inhibited, imposing closing of the second inlet orifice 82, and opening of the second outlet orifice 84. Any gas inlet at high pressure into the downstream volume of the jack 46 is rendered impossible during the opening phase. The downstream volume of the jack 46 is permanently in communication with the second low pressure compartment 32 so as not to oppose the downward movement of the piston 48.

CLOSING

Figure 7:
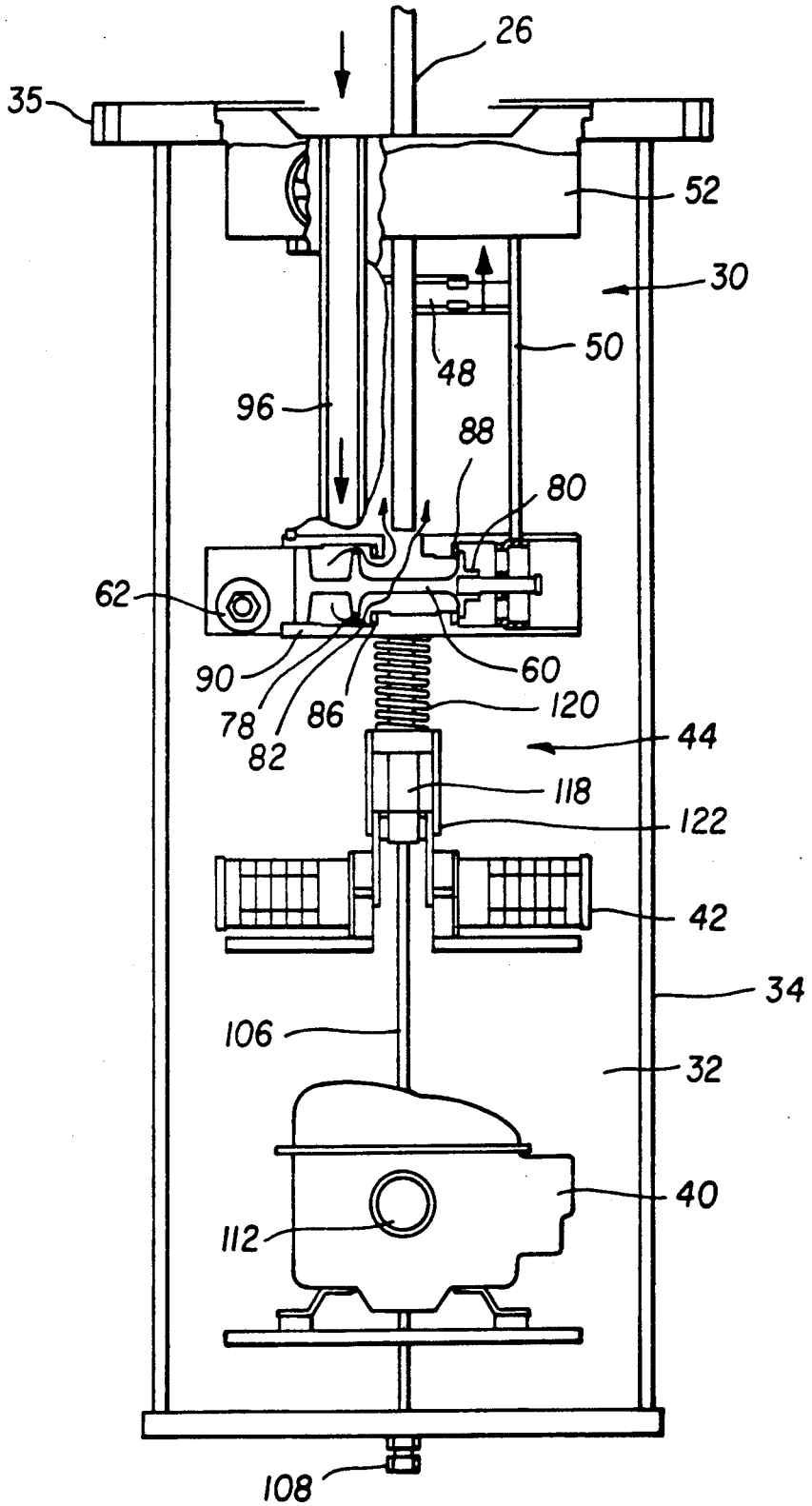
FIGS. 7 and 8 are two identical views to FIGS. 5 and 6, respectively during and at the end of the circuit breaker closing travel.
Figure 8:
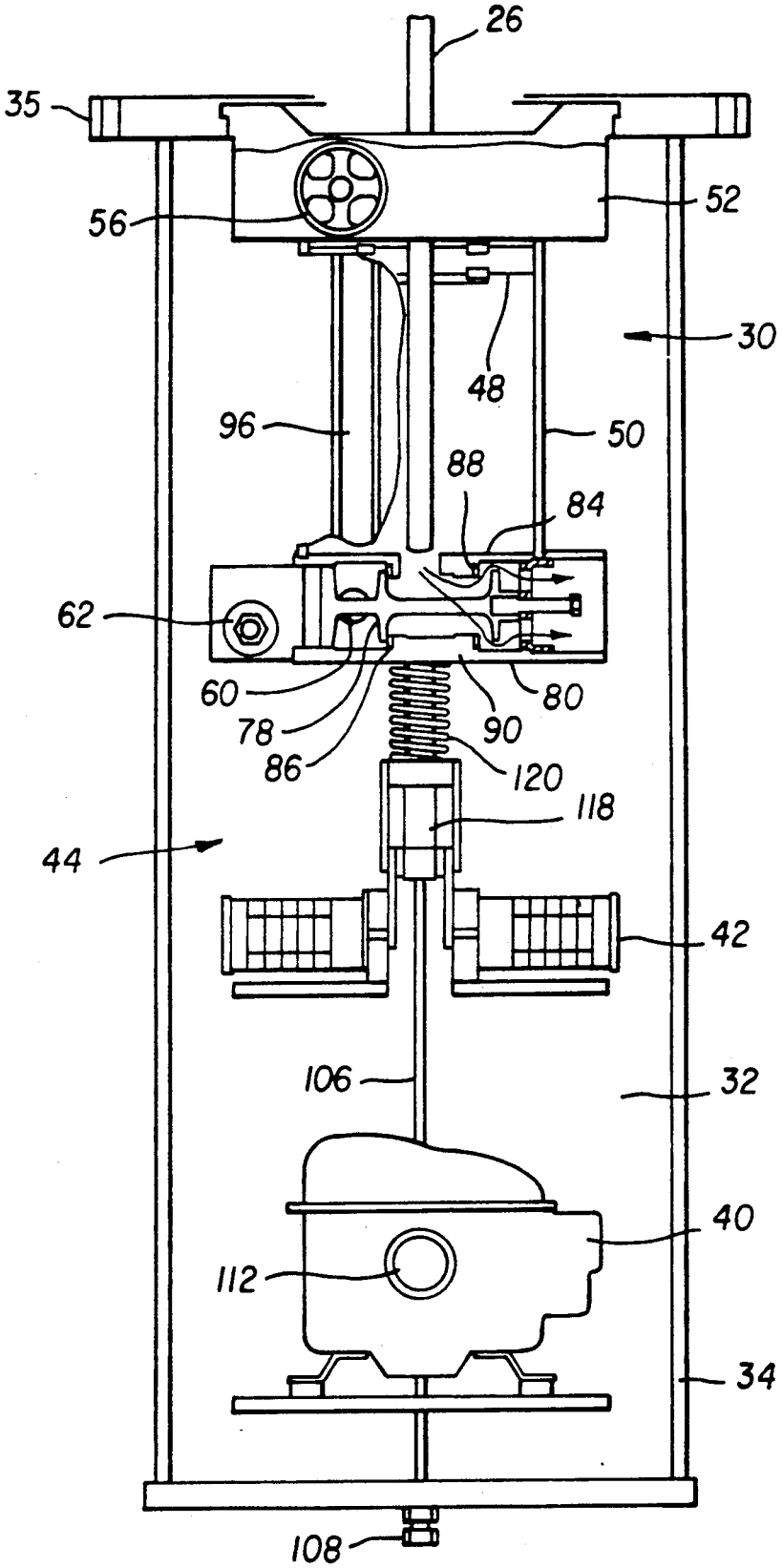

The closing order of the contacts 22, 24 of the circuit breaker 12 results from energization of the closing electromagnet 62 (FIG. 7). The second valve 60 moves to the left causing opening of the second inlet orifice 82 and closing of the second outlet orifice 84. The SF6 gas at high pressure, coming from the first compartment 20, fills the downstream volume of the jack 46 via the aperture 92, pipe 96 and inlet orifice 82, and urges the moving piston 48 upwards.

At the end of the upper travel of the piston 48 (FIG. 8), the supply to the closing electromagnet 62 is stopped by operation of the auxiliary contacts device 42. The second valve 60 automatically returning to the right closes the second inlet orifice 82 and opens the second outlet orifice 84, so as to stop the gas inlet at high pressure into the jack 46. Opening of the outlet orifice 84 makes the downstream volume of the jack 46 communicate with the second low pressure compartment 32. The contacts 22, 24 are then in the closed state, and are kept in this position after the dead point of the mechanical connection 44, which is securedly united to the actuating rod 26, has been passed.

Energization of the opening electromagnet 56 is prevented during the closing phase of the circuit breaker 12, and the first valve 64 is in the state in FIG. 6.

MONITORING THE SF6 GAS PRESSURE

The control device 98 with the button 100 acts on the inlet cross-section of the two apertures 92, 94 according to the variation of the gas temperature detected by the bimetal spring 101 in the first compartment 20. The pressure of the gas contained in the upstream volume, and in the downstream volume of the jack 46, after the corresponding inlet orifice 74, 82 has opened, can then easily be adjusted to a preset threshold.

Injection of SF6 into the first compartment 20 at high pressure takes place before the circuit breaker 12 is put into service via the filling orifice 108, connected by a pipe to the duct 106 associated with the aperture 92.

After each closing and/or opening operation, the pressure decrease in the first compartment 20 is detected by the pressure switch 116, which close the supply contact 114 of the compressor 40 to recharge the circuit breaker 12. The compressor 40 takes in the SF6 gas contained in the second compartment 32 at low pressure, and discharges it after compression to the first compartment 20. The compressor 40 stops automatically as soon as the pressure in the compartment 20 reaches the setpoint value (6 bars). The mechanism 30 is then operational for a new operation.

It is noteworthy that all the operating and pressure monitoring components of the SF6 circuit breaker 12 are located inside the enclosure 34 in the second compartment 32. The same SF6 gas is used for insulation, arc breaking and operating control, and the two compartments 20, 32 form a single autonomous structure.

According to an alternative embodiment (not shown), the dual-effect piston 48 of the jack 46 in FIGS. 1 to 7 can be replaced by a differential piston jack. Any other insulating gas can be used instead of the SF6. The embodiment described with reference to FIGS. 1 to 7 relates to an "open" type high-voltage circuit breaker, but the invention can naturally be applied to a metalclad circuit breaker.

I claim:

1. A high-voltage gas-insulated circuit breaker, comprising:

a first sealed compartment filled with a high dielectric strength insulating gas at a first pressure, said first sealed compartment housing at least one breaking pole comprising stationary and movable contacts;

an arc extinguishing device housed within said first sealed compartment for extinguishing an arc formed between said stationary and movable contacts upon separation thereof;

a contact actuating rod coupled to said movable contact, said contact actuating rod extending longitudinally axially inside said first sealed compartment;

a second sealed compartment fixed to an end of said first sealed compartment and separated therefrom by a separating wall, said second sealed compartment filled with said high dielectric strength insulating gas at a second pressure which is lower than said first pressure;

a pneumatic operating mechanism disposed within said first sealed compartment and coupled to said contact actuating rod, said pneumatic operating mechanism comprising a fixed cylinder and a piston coupled to said contact actuating rod, said piston being able to be slidably driven within said fixed cylinder by flow of said insulating gas from said first sealed compartment into said fixed cylinder;

a first distribution means disposed within said second compartment and at one end of said fixed cylinder to allow flow of said insulating gas from said first compartment into said fixed cylinder to drive said piston in a first direction; and a second distribution means disposed within said second compartment and at an opposite end of said fixed cylinder to allow flow of said insulating gas from said first compartment into said fixed cylinder to drive said piston in a second direction;

wherein said insulating gas flowed into said fixed cylinder is expelled therefrom into said second sealed compartment after said piston is driven in said first direction or said second direction, said second sealed compartment thereby providing an expansion volume for said insulating gas expelled from said fixed cylinder.

2. The circuit breaker of claim 1, wherein said first distribution means comprises an opening electromagnet and an opening control valve, wherein said opening control valve is cooperable between a first position and a second position by energization and de-energization of said opening electromagnet, respectively, said first position allowing gas flow from said first sealed compartment to said fixed cylinder via a first inlet orifice, said first inlet orifice being in gas communication with a first aperture, and said second position allowing gas flow from said fixed cylinder to said second sealed compartment via a first outlet orifice, and wherein said second distribution means comprises a closing electromagnet and a closing control valve, wherein said closing control valve is cooperable between a first position and a second position by energization and de-energization of said closing electromagnet, respectively, said first position allowing gas flow from said first sealed compartment to said fixed cylinder via a second inlet orifice, said second inlet orifice being in gas communication with a second aperture, and a second position allowing gas flow from said fixed cylinder to said second sealed compartment via a second outlet orifice.

3. The circuit breaker of claim 2, wherein said first aperture is disposed adjacent to said first inlet orifice for direct gas communication therebetween, and said second aperture is in indirect gas communication with said second inlet orifice via a connecting pipe.

4. The circuit breaker of claim 2, further comprising a control device to partially block said first and second apertures based on a variation of temperature of said insulating gas in said first sealed compartment, thereby adjusting a threshold pressure of said pneumatic operating mechanism.

5. The circuit breaker of claim 4, wherein said control device comprises two radial lugs fixed to a radial button, and a bi-metal spring which is temperature sensitive to rotatably drive said radial button and said radial lugs based on said variation of temperature, thereby partially blocking said first and second apertures with said radial lugs.

6. The circuit breaker of claim 1, further comprising a mechanical tumbler coupled to said contact actuating rod, said mechanical tumbler configured to have a passover point, whereby an additional force is generated as said mechanical tumbler compresses or extends past said passover point, thereby maintaining an open or closed position of said breaking pole.

7. The circuit breaker of claim 6, wherein said mechanical tumbler comprises a rod system cooperable with a compressing spring arranged to generate said additional force after extension or compression of said mechanical tumbler connection past said passover point.

8. The circuit breaker of claim 6, further comprising an auxiliary contact device fixed to said mechanical tumbler, said auxiliary contact device comprising a first contact means to indicate open and closed positions of said breaking pole according to a position of said piston, and a second contact means electrically connected to said opening and closing electromagnets to interrupt power supplied to said opening and closing electromagnets after said piston has been driven.

9. The circuit breaker of claim 3, wherein said second sealed compartment houses a compressor having an intake orifice open to said second sealed compartment and a discharge orifice connected to said first sealed compartment via an intermediate duct, and a pressure switch for detecting a pressure differential between said first and second sealed compartments, whereby said insulating gas in said second sealed compartment is taken in through said intake orifice, compressed by said compressor, and flowed into said first sealed compartment to maintain said first pressure therein, said compressor being triggered by said pressure switch upon detection of a predetermined differential pressure condition detected by said pressure switch.

10. The circuit breaker of claim 9, further comprising a filling orifice disposed along a wall of said second sealed compartment, said filling orifice connected to said intermediate duct to fill said first sealed compartment with said insulating gas.

11. The circuit breaker of claim 1, wherein said insulating gas is $SF_6$ gas.

* * * * *